US006880631B1

(12) United States Patent
McGarian et al.

(10) Patent No.: US 6,880,631 B1
(45) Date of Patent: Apr. 19, 2005

(54) WHIPSTOCK CASING MILLING SYSTEM

(75) Inventors: Bruce McGarian, Aberdeen (GB); Charles H. Dewey, Houston, TX (US)

(73) Assignee: Smith International Inc., Houston, TX (US)

( * ) Notice: Subject to any disclaimer, the term of this patent is extended or adjusted under 35 U.S.C. 154(b) by 0 days.

(21) Appl. No.: 09/937,399

(22) PCT Filed: Mar. 24, 2000

(86) PCT No.: PCT/GB00/01162

§ 371 (c)(1),
(2), (4) Date: Nov. 28, 2001

(87) PCT Pub. No.: WO00/58594

PCT Pub. Date: Oct. 5, 2000

(30) Foreign Application Priority Data

Mar. 26, 1999 (GB) ..... 9907116

(51) Int. Cl.[7] ..... E21B 23/00; E21B 7/08

(52) U.S. Cl. ..... 166/117.6; 166/50; 166/55.7; 166/297; 175/61; 175/81

(58) Field of Search ..... 166/313, 50, 117.5, 166/117.6, 297, 55, 55.7; 175/61, 62, 320, 79, 81, 82

(56) References Cited

U.S. PATENT DOCUMENTS 3,908,759 A * 9/1975 Cagle et al. ..... 166/117.6
5,551,509 A 9/1996 Braddick
5,595,247 A 1/1997 Braddick
5,720,349 A * 2/1998 Pleasants et al. ..... 166/298
5,787,978 A 8/1998 Carter et al.
5,816,324 A * 10/1998 Swearingen et al. ..... 166/117.5
5,826,651 A * 10/1998 Lee et al. ..... 166/117.6
5,881,808 A * 3/1999 Rehbock et al. ..... 166/117.5
5,894,889 A * 4/1999 Dewey et al. ..... 166/298

FOREIGN PATENT DOCUMENTS

| | | |
|---|---|---|
| GB | 2 310 231 | 8/1997 |
| GB | 2 312 702 | 11/1997 |
| GB | 2 313 391 | 11/1997 |
| GB | 2 328 968 | 3/1999 |

OTHER PUBLICATIONS

International Publ. No. WO 98/04804, by Mark H. Lee et al., Apparatus and Method for Milling a Hole in A Casing.

* cited by examiner

*Primary Examiner*—David Bagnell
*Assistant Examiner*—Jennifer Gay
(74) *Attorney, Agent, or Firm*—Dykema Gossett PLLC

(57) ABSTRACT

This invention relates to a whipstock casing milling system and, more particularly, to such a system in which a window mill is secured to a whipstock so that the system may be run into a well, set and operated to open a window in a casing during a single trip. The milling system of the present invention comprises a protrusion (B) provided on the whipface of the whipstock wherein the protrusion (B) forms an extension of a relatively steep ramp surface (45) of the whipface so as to reduce damage to said surface (45) at a juncture (A) of said surface (45) with a relatively shallow ramp surface or parallel surface (46) during use of the system. The protrusion (B) thereby avoids an undercutting of a casing and a thinning of the whipstock.

7 Claims, 2 Drawing Sheets

PRIOR ART

WHIPSTOCK CASING MILLING SYSTEM

This invention relates to a whipstock casing milling system, and more particularly to such a system in which a window mill is secured to the whipstock so that the system may be run into a well, set and operated to open a window in the casing in a single trip.

A one trip casing milling system as described above is shown in our British patent publication GB2312702A. In the system described in this patent specification, a window mill is secured by means of a shear bolt to the end of the whipstock. The window mill includes a tapered end, the taper of which matches the ramp angle of the end portion of the whipstock. This ramp angle is relatively steep (typically 15°) so that, at the start of casing milling, the window mill is forced rapidly into the casing in order to form an initial opening.

Whilst this system for effecting the initial break through of the casing offers considerable advantages over the prior art, the arrangement does have the disadvantage that the area of contact between the tapered portion of the window mill and the initial steep ramp surface on the whipstock (i.e. the bearing area) decreases as the window mill begins to penetrate the casing. Although the whipstock ramp continues to apply a lateral force to the window mill the reaction force on the whipstock becomes progressively concentrated on a small region of the ramp face. Even though the whipstock ramp may be hardened, the fact that the reaction force from the window mill is concentrated on a relatively small area of the ramp tends to lead to wear of the ramp. This wear is particularly noticeable at the point where there is a change of whipstock angle at the bottom end of the initial steep ramp portion. Immediately before the casing milling tool begins to run down the relatively shallow angled (or parallel) portion of the whipstock below the steep ramp, the entire reaction force applied by the window mill to the whipstock is concentrated in this small area. Even if the whipstock is extensively hardened in this area, wear will inevitably occur. One result of this wear is that the window in the casing is not opened up as quickly as might be expected from the initial (pre-wear) profile of the whipstock. One prior art system according to the preamble of the appended claims (disclosed under international publication number WO 98/04804) provides a partial solution to this problem but does not necessarily allow prevention of undesirable ramp wear under given conditions.

We have now devised a complete solution to the aforementioned problem.

The present invention provides a whipstock casing milling system and a method for using the system.

The protrusion will, in practice, be milled partially or completely away during the casing milling operation. However, the existence of the protrusion prevents the excessive damage to the relatively steep ramp surface of the whipface such as has occurred in the prior art. The protrusion may be of any suitable material for example steel of a suitable grade.

Ideally, the protrusion is provided on the relatively shallow ramp surface or parallel surface of the whipface. Preferably, the protrusion is removably secured to the whipface. The protrusion may be movably secured by means of at least one threaded fastener. It is further preferable for the protrusion to comprise a surface which is ramped at the same angle relative to the longitudinal axis of the whipstock as the relatively steep ramp surface. The ramped surface of the protrusion and the relatively steep ramp surface are ideally ramped at an angle of 15° relative to the longitudinal axis of the whipstock.

The invention will be better understood from the following description of a preferred embodiment thereof given by way of example only, reference being had to the accompanying drawings, wherein:

FIG. 1 corresponds to FIG. 4 of the above mentioned GB2312702A;

Figure 1:
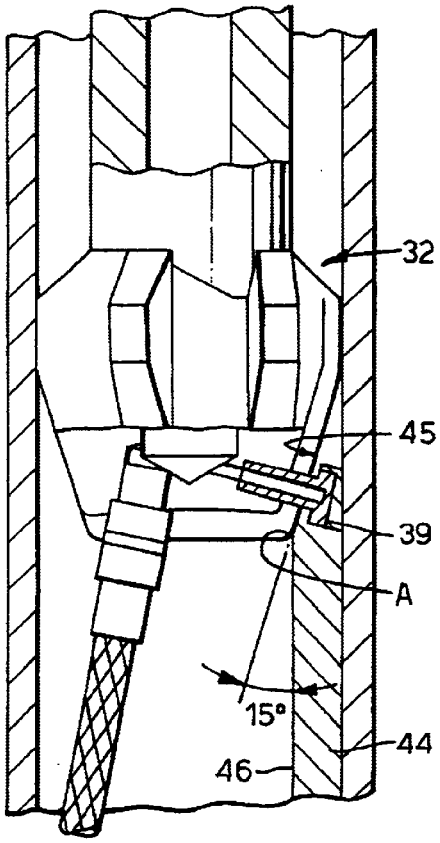

Turning firstly to FIG. 1, there is shown a portion of the casing milling system of GB2312702A. Reference should be had to the text of this patent publication for further description of the illustrated system. For the present purposes however, it is sufficient to note that the illustrated system comprises a window mill 32 which is secured to a whipstock 44 by a shear bolt 39. The whipstock has a whipface which includes a relatively steep starter surface 45 followed by a vertical surface 46 (i.e. a surface parallel to the longitudinal axis of the casing). The relatively steep starter surface 45 meets the vertical surface 46 at a transition point A. In use, after the illustrated casing milling system has been run in hole, a packer or anchor secured to the bottom of the whipstock is set and the window mill 32 is released by shearing the shear bolt 39. The drill string is then rotated and weight applied to the window mill 32. The window mill runs up the relatively steep starter surface 45 on the whipstock and is thereby forced laterally into the casing on the side thereof opposite the whipstock. The casing is disintegrated and the window mill moves downwardly.

It will be appreciated that immediately before the window mill moves on to the vertical section 46 of the whipface, the entire reaction force of the window mill onto the whipface is taken by the portion of the starter surface 45 immediately adjacent the juncture A. This results in wear of the whipface at this point with the result that the window mill is not forced cleanly through the casing as intended in the original design.

Figure 2:
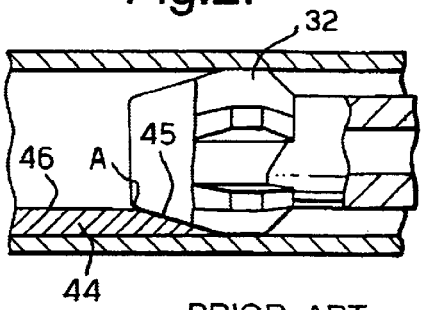
PRIOR ART Fig.2.
FIGS. 2, 3 and 4 illustrate the milling apparatus of FIG. 1 in use during a casing milling operation.
Figure 3:
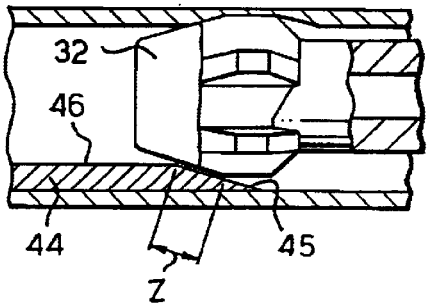
PRIOR ART Fig.3.
Figure 4:
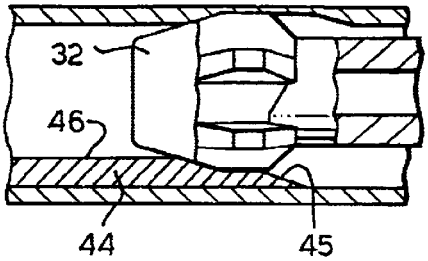
PRIOR ART Fig.4.

Indeed, wear of the steep starter surface 45 typically begins well before the window mill 32 progresses onto the vertical surface 46. This is illustrated in FIGS. 2, 3 and 4 of the accompanying drawings. In FIG. 2, the window mill 32 is shown at the foot of the steep starter surface 45 prior to commencing cutting of the well casing. As the window mill 32 is pushed up the starter surface 45, the bearing area (i.e. the area of contact between the window mill and the starter surface) reduces. The lateral reaction force applied by the well casing onto the window mill does not reduce however and indeed tends to increase with the depth of cut. The stress in the starter surface 45 produced by the window mill 32 is a function of the lateral reaction force and the bearing area. The dependency is such that the stress in the starter surface 45 increases both as the lateral reaction force increases and as the bearing area decreases. Accordingly, as the window mill 32 moves up the starter surface 45, the stress in the starter surface 45 will increase until a critical level is attained, at which point, the starter surface 45 will begin to disintegrate. The minimum bearing area Z before disintegration of the starter surface 45 begins is shown in FIG. 3. As the window mill 32 progresses up the starter surface 45 so as to reduce the bearing area below the minimum value, disintegration of the whipstock begins and the angle of the starter surface 45 is effectively reduced. An undercutting of the well casing results. Depending upon the operational circumstances (including, for example, the relative hardness of the whipstock and the well casing), the angle of the starter surface 45 can, in an extreme case be reduced to zero (see FIG. 4). In this event, a window in the well casing will not be formed.

Figure 5:
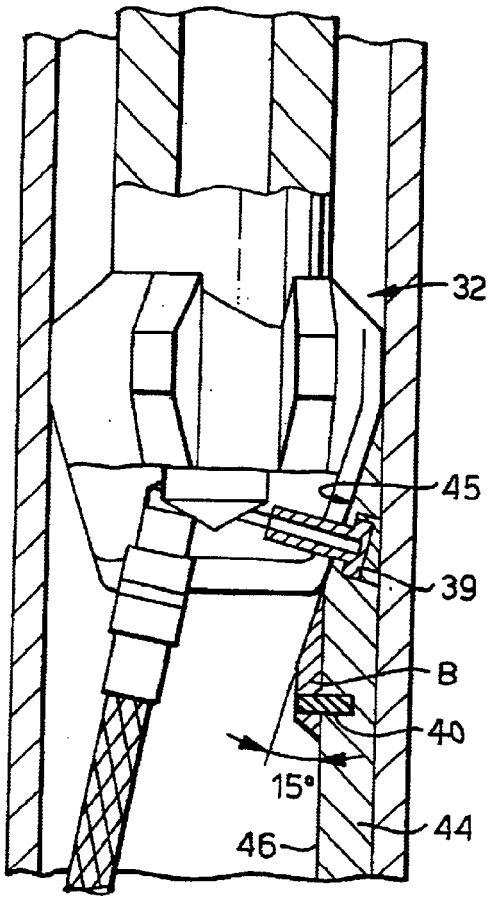
FIG. 5 illustrates the improvement according to the present invention.

Referring now to FIG. 5, the above outlined problem is solved by means of a protrusion B which is provided on the whipface immediately below the lower end of the starter surface 45. The protrusion B in effect extends the starter surface 45 downwardly of the well. The effect of the protrusion is to provide extra support for the reaction forces imposed on the whipface by the window mill and thereby reduce or prevent the undesired wearing away of the starter surface 45 itself. In practice, the protrusion will in general be milled away in use by the window mill. However, the existence of the protrusion ensures that adequate lateral movement of the window mill is achieved before the window mill starts traveling down the vertical surface 46. The protrusion can be of any suitable material and can be secured to the whipface by any convenient means, for example by means of screws (such as 40 shown in FIGS. 5 to 8), or by welding.

Figure 6:
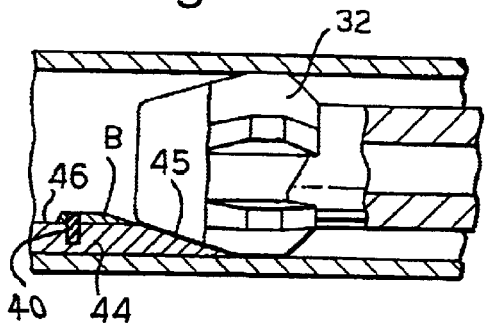
FIGS. 6, 7 and 8 illustrate the milling apparatus of FIG. 5 in use during a casing milling operation.
Figure 7:
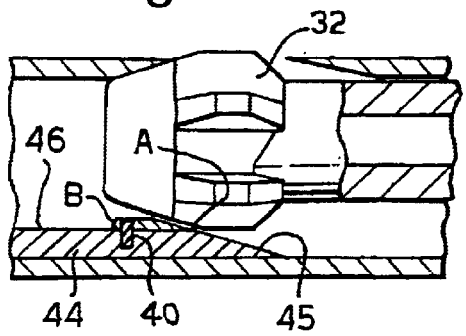

Use of a whipstock casing milling system according to the present invention is shown in FIGS. 6, 7 and a of the accompanying drawings. In FIG. 6, the window mil 32 is shown at the foot of the steep starter surface 45 prior to commencing cutting of the well casing. As the window mill 32 is pushed up the starter surface 45, the bearing area initially remains constant due to the provision of the protrusion B. It is only as the window mill 32 is pushed bed the extended start surface 45 (see FIG. 7) that the bearing area begins to reduce. This reduction in bearing area contributes to a increase in the stress within the starter surface 45 and the extension provided by protrusion B. However, the protrusion B is sized so that starter surface 45 is sufficiently extended for attainment of the critical stress level to be delayed until the required lateral displacement of the window mill 32 has occurred. As intimated above, this required lateral displacement occurs when the window mill 32 (specifically the largest outer diameter of the window mill 32) reaches the juncture A between the vertical section 46 of the whipface and the (unexteneded) starter surface 45.

The extension to the starter surface 45 provided by the protrusion B is sized so as to provide a contact area with the window mill 32 substantially equal to the minimum bearing area Z indicated in FIG. 3 (assuming the protrusion B is of an identical material to that of the whipstock and the forces exerted by the window mill 32 having reached juncture A (see FIG. 7) are identical to those exerted by the window mill 32 located in the critical position shown in FIG. 3). A skilled person will be capable of calculating the precise dimensions of the protrusion B in view of known operating circumstances.

Figure 8:
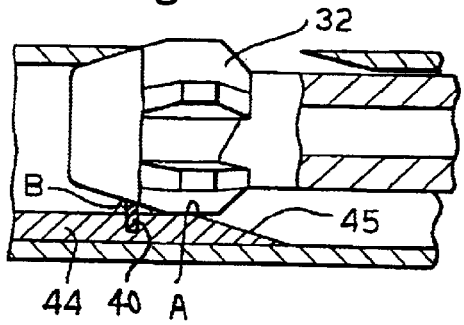

Once the window mill 32 has progressed up the starter surface 45 to the position indicated in FIG. 7, the lateral reaction forces exerted by the window mill 32 in cutting into the wellbore side are borne solely by the protrusion B. The arrangement is such that the critical stress level is not rill attained until the window mill 32 progresses to or beyond the position of FIG. 7. When the critical stress level is attained, the protrusion B is either partially or wholly (as shown in FIG. 8) milled away. The starter surface 45 and vertical section 46 of the whipface remain substantially undamaged and a window is opened as required. The whipstock itself may be used in future operations with a replacement protrusion B.

The present invention is not limited to the specific embodiment described above. Alternative arrangements and suitable materials will be apparent to a reader skilled in the art.

What is claimed is:

1. A whipstock casing milling system comprising: a whipstock having a whipface, the whipface comprising a first ramp surface and a second ramp surface or parallel surface meeting the first ramp surface at a juncture, the first ramp surface being relatively steep compared to the second ramp surface, said surfaces being ramped or parallel relative to the longitudinal axis of the whipstock such that the first ramp surface is disposed at a greater angle to said longitudinal axis than the second ramp surface; a window mill secured to the whipstock adjacent the first ramp surface and operable in use to form an opening in a wellbore casing in which the whipstock casing milling system is located, milling blades of the window mill being directly engaged with and deflected by the first ramp surface laterally into the casing as the window mill is rotated and forced along the first ramp surface toward the second ramp or parallel surface; and a protrusion provided on the whipface, the protrusion forming an extension of the first ramp surface of the whipface and being directly engaged by said milling blades as said milling blades travel along said first ramp surface onto said extension so as to reduce damage to the first ramp surface at the juncture of the first ramp surface and the second ramp or parallel surface during use of the system, the first ramp surface and the extension together forming a mill deflecting slope; wherein the length of the extension being such that, in use, the surface area of the milling blades directly engaging said first ramp surface section of said mill deflecting slope reduces as a consequence of the mill moving along and projecting beyond said first ramps surface section of said mill deflecting slope, an increase in stress in said first ramp surface section of said mill deflecting slope due to said reduction in surface area being maintainable below a level which would cause damage to said first ramp surface section of said mill deflecting slope until the mill has moved beyond the relatively steep first ramp surface and is no longer in engagement therewith.

2. A whipstock casing mill system as claimed in claim 1, wherein a level of stress in said slope which would cause damage to said slope is attained when the mill moves beyond the first ramp surface and is no longer in engagement therewith.

3. A whipstock casing milling system as claimed in claim 1, wherein the protrusion is provided on the second ramp or parallel surface of the whipface.

4. A whipstock casing milling system as claimed in claim 1, wherein the protrusion is removably secured to the whipface.

5. A whipstock casing milling system as claimed in claim 1, wherein the protrusion is removably secured to the whipface by at least one threaded fastener.

6. A whipstock casing milling system as claimed in claim 1, wherein the protrusion comprises a surface which is ramped at the same angle relative to the longitudinal axis of the whipstock as the first ramp surface.

7. A whipstock casing milling system as claimed in claim 6, wherein said ramped surface of the protrusion and the first ramp surface are ramped at an angle of 15° relative to the longitudinal axis of the whipstock.

* * * * *